US006988691B1

(12) United States Patent
Lai

(10) Patent No.: US 6,988,691 B1
(45) Date of Patent: Jan. 24, 2006

(54) FLOOR RACK FOR HOLDING A PAPER TOWEL ROLL AND THE LIKE

(76) Inventor: Ming-Hsiao Lai, No. 8, Lane 2, Kung Chi Village, Ta Tsuen Hsiang, Chang-Hua Hsien (TW)

( * ) Notice: Subject to any disclaimer, the term of this patent is extended or adjusted under 35 U.S.C. 154(b) by 0 days.

(21) Appl. No.: 10/684,004

(22) Filed: Oct. 14, 2003

(51) Int. Cl.
*B65H 16/02* (2006.01)

(52) U.S. Cl. ..... 242/594; 242/597.7; 242/597.8; 242/597.6; 242/598.5; D6/520; D6/521; D6/522; D6/523

(58) Field of Classification Search ..... 242/594, 242/594.3, 594.5, 597, 597.5, 597.7, 597.8, 242/594.6, 597.6, 598.5; D6/520, 521, 522, D6/523

See application file for complete search history.

(56) References Cited

U.S. PATENT DOCUMENTS

| | | | | |
|---|---|---|---|---|
| 3,227,386 A * | 1/1966 | Pitcher | ..... | 242/597.5 |
| 5,743,485 A * | 4/1998 | Martorelli et al. | ..... | 242/597.7 |
| D461,667 S * | 8/2002 | Jordan | ..... | D6/520 |
| 6,698,683 B2 * | 3/2004 | Young | ..... | 242/597.8 |

* cited by examiner

*Primary Examiner*—John Q. Nguyen
(74) *Attorney, Agent, or Firm*—Egbert Law Offices

(57) ABSTRACT

A floor rack is designed to hold a plurality of paper towel rolls and is formed of a base, a support post, a first holder, and one or more second holders. The support post is uprightly extended from the base. The first holder is fastened with a top end of the support post for holding a paper towel roll ready to serve. The second holders are fastened to the support post for holding a plurality of standby paper towel rolls.

4 Claims, 7 Drawing Sheets

FLOOR RACK FOR HOLDING A PAPER TOWEL ROLL AND THE LIKE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a floor rack for holding paper towel rolls. The floor rack is provided with means to hold a standby paper towel roll.

BACKGROUND OF THE INVENTION

As shown in FIG. 7, a floor rack of the prior art comprises a base 50, an upright support post 51, and a paper towel holder 52. Such a prior art floor rack as described above is defective in design in that it is not provided with means to hold a paper towel roll which can be put into service on an emergency basis.

BRIEF SUMMARY OF THE INVENTION

The primary objective of the present invention is to provide a floor rack for holding paper towel rolls. The floor rack comprises a first holder and a second holder. The first holder is used to hold a paper towel roll ready to serve, while the second holder is used to hold a standby paper towel roll.

The features and the advantages of the present invention will be more readily understood upon a thoughtful deliberation of the following detailed description of the preferred embodiments of the present invention with reference to the accompanying drawings.

DETAILED DESCRIPTION OF THE INVENTION

Figure 1:
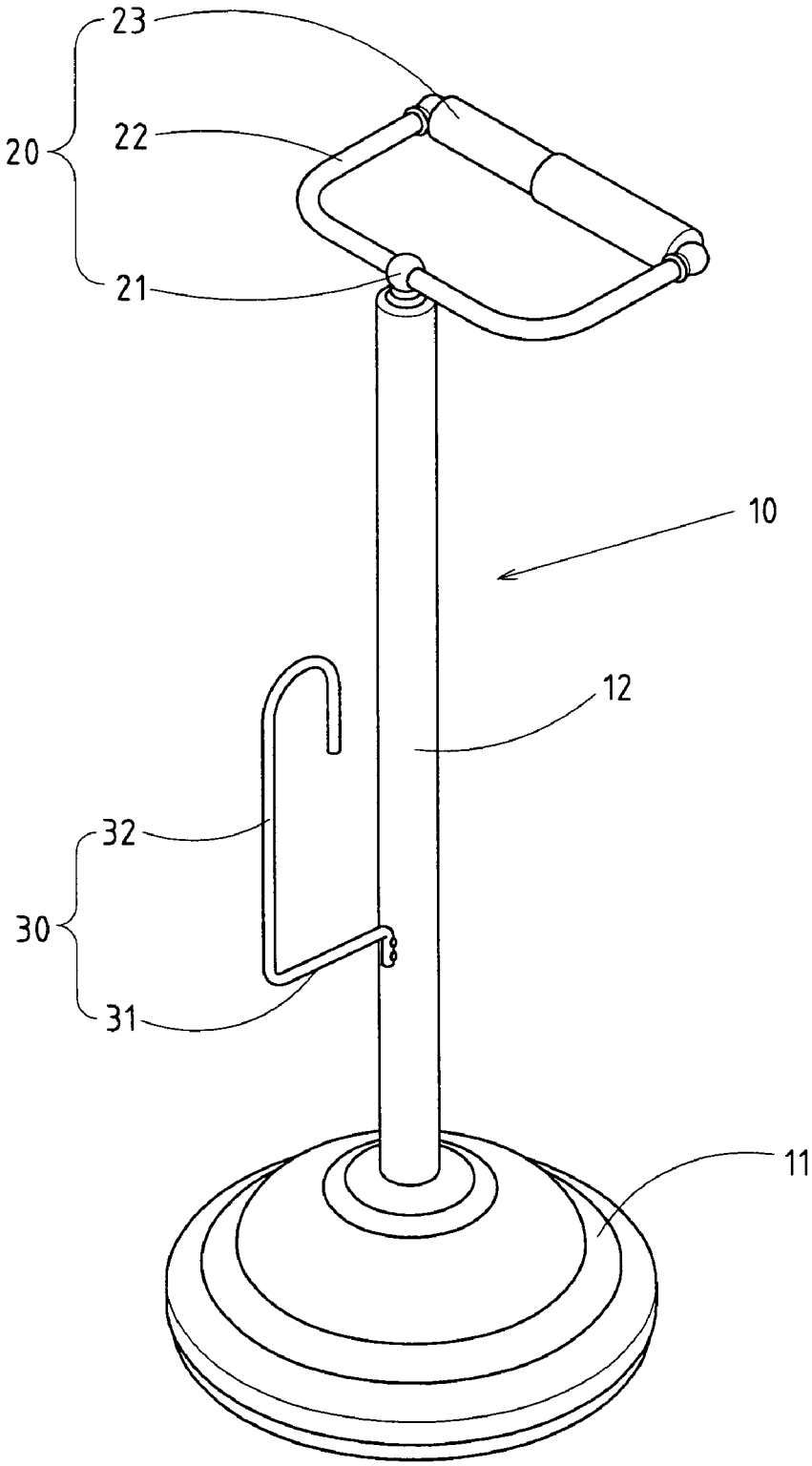
FIG. 1 shows a perspective view of a first preferred embodiment of the present invention.
Figure 2:
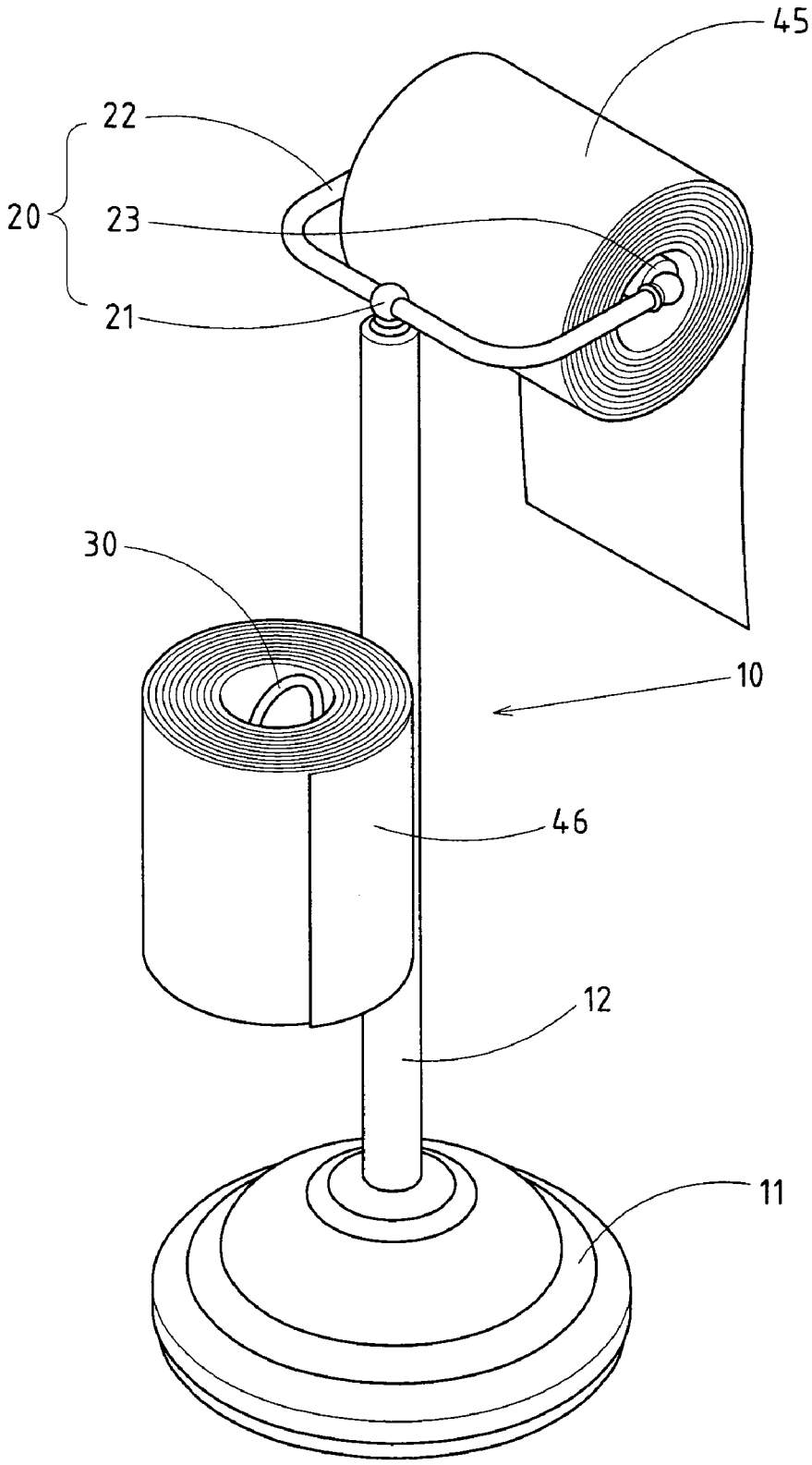
FIG. 2 shows a perspective view of the first preferred embodiment of the present invention at work.
Figure 3:
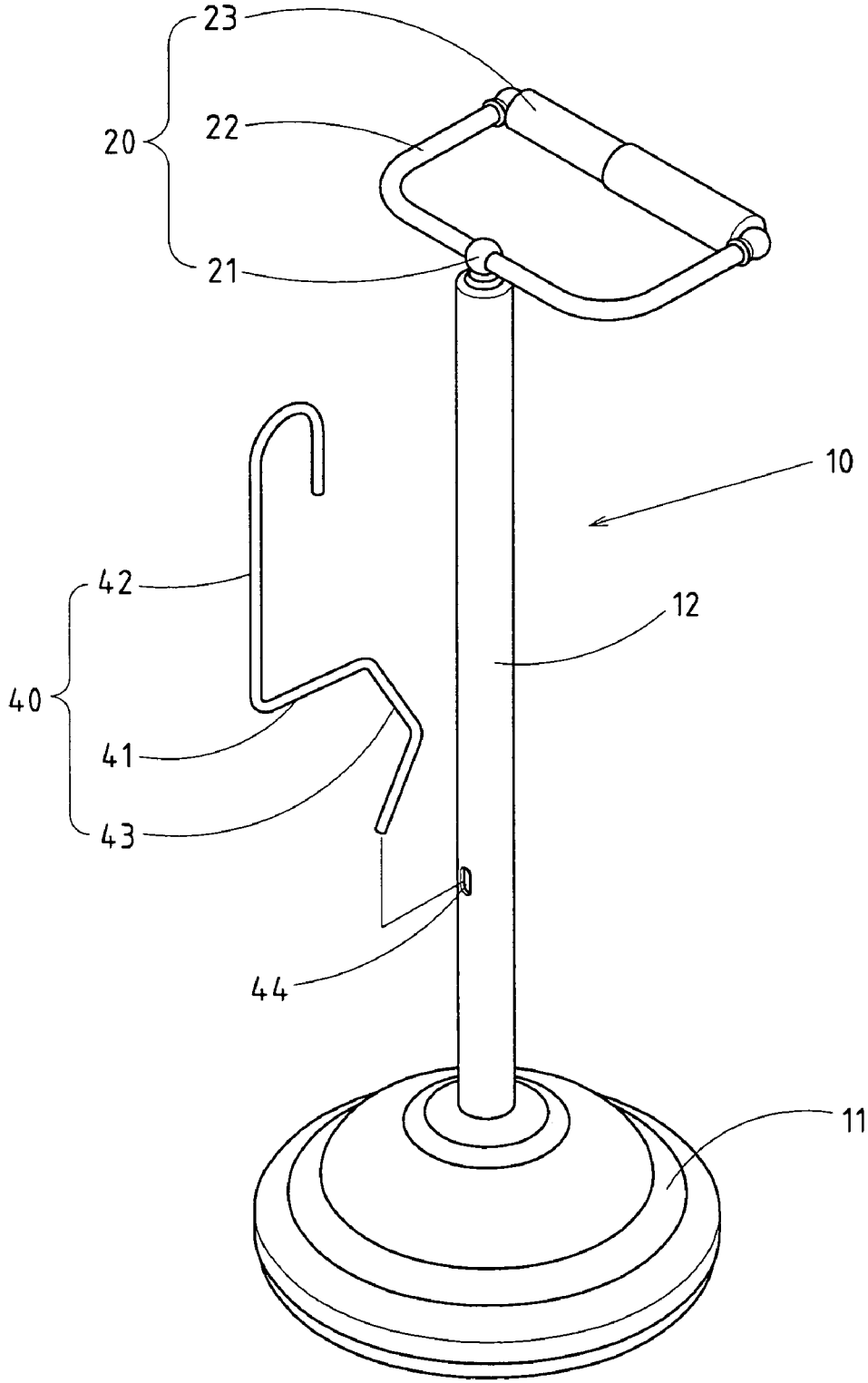
FIG. 3 shows a partial exploded perspective view of a second preferred embodiment of the present invention.
Figure 4:
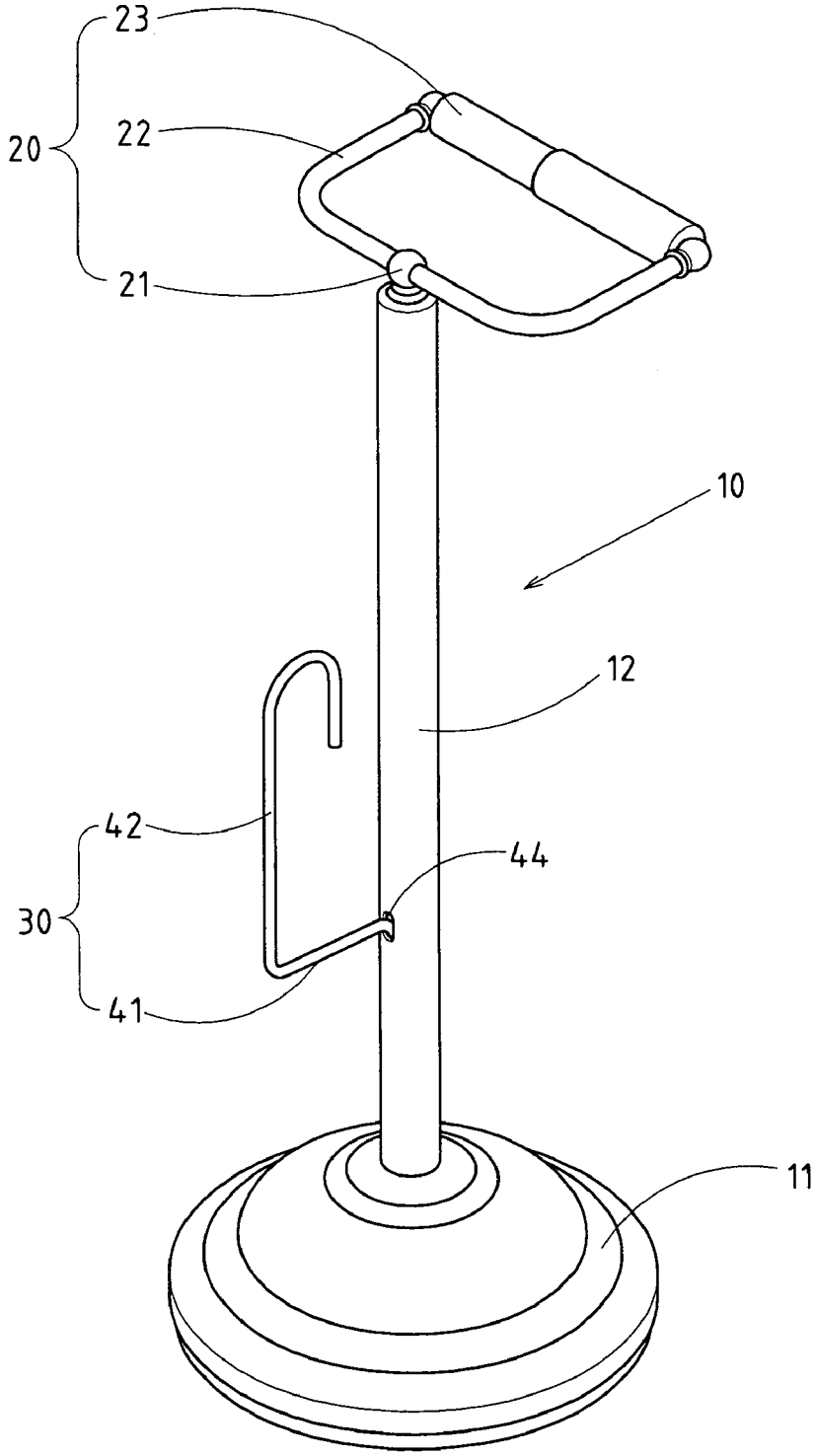
FIG. 4 shows a perspective view of the second preferred embodiment of the present invention.

As shown in FIGS. 1 and 2, a floor rack 10 embodied in the present invention comprises a base 11, a support post 12 extending uprightly from the base 11, a first holder 20 for holding a paper towel roll 45 ready to serve, and a second holder 30 for holding a standby paper towel roll 46.

The first holder 20 is formed of a fastening portion 21, a support frame 22, and a holding rod 23 for holding a paper towel roll 45. The fastening portion 21 is fastened to a top end of the support post 12.

The second holder 30 has a fastening arm 31 and a holding arm 32 extending from the fastening arm 31 such that the holding arm 32 is perpendicular to the fastening arm 31. The fastening arm 31 is fastened at one end by welding to a lower segment of the upright support post 12. The holding arm 32 is used to hold the standby paper towel roll 46.

Figure 5:
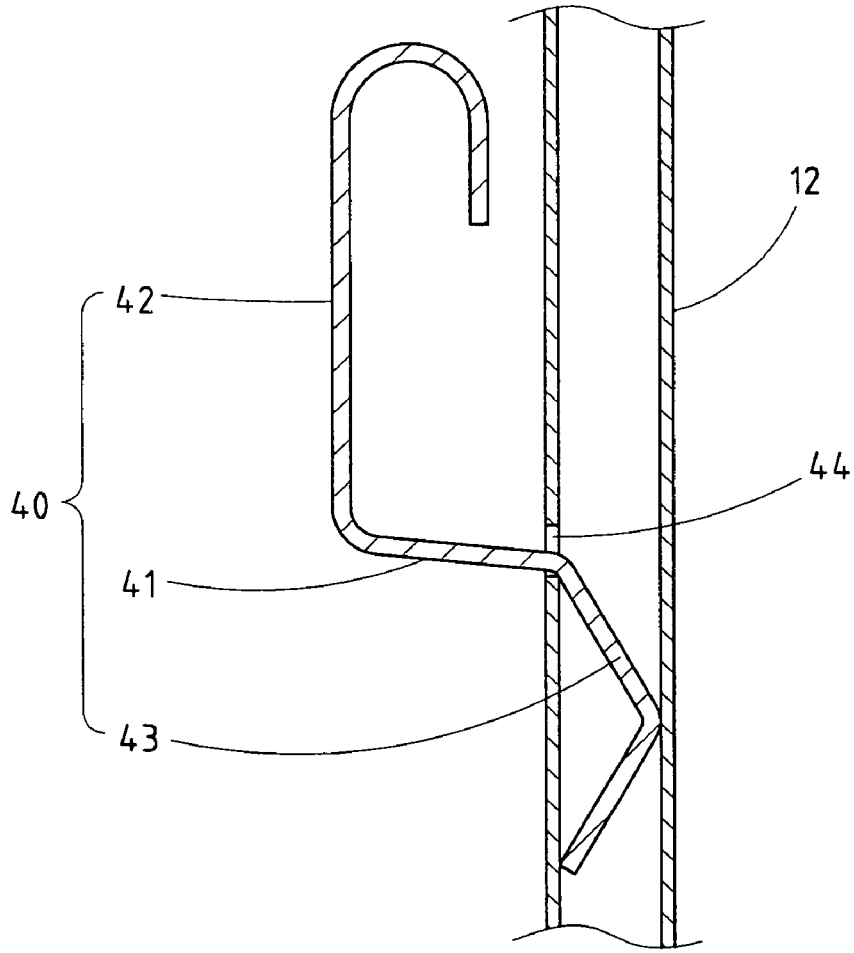
FIG. 5 shows a sectional schematic view of the second holder and a portion of the upright support post of the second preferred embodiment of the present invention.
Figure 6:
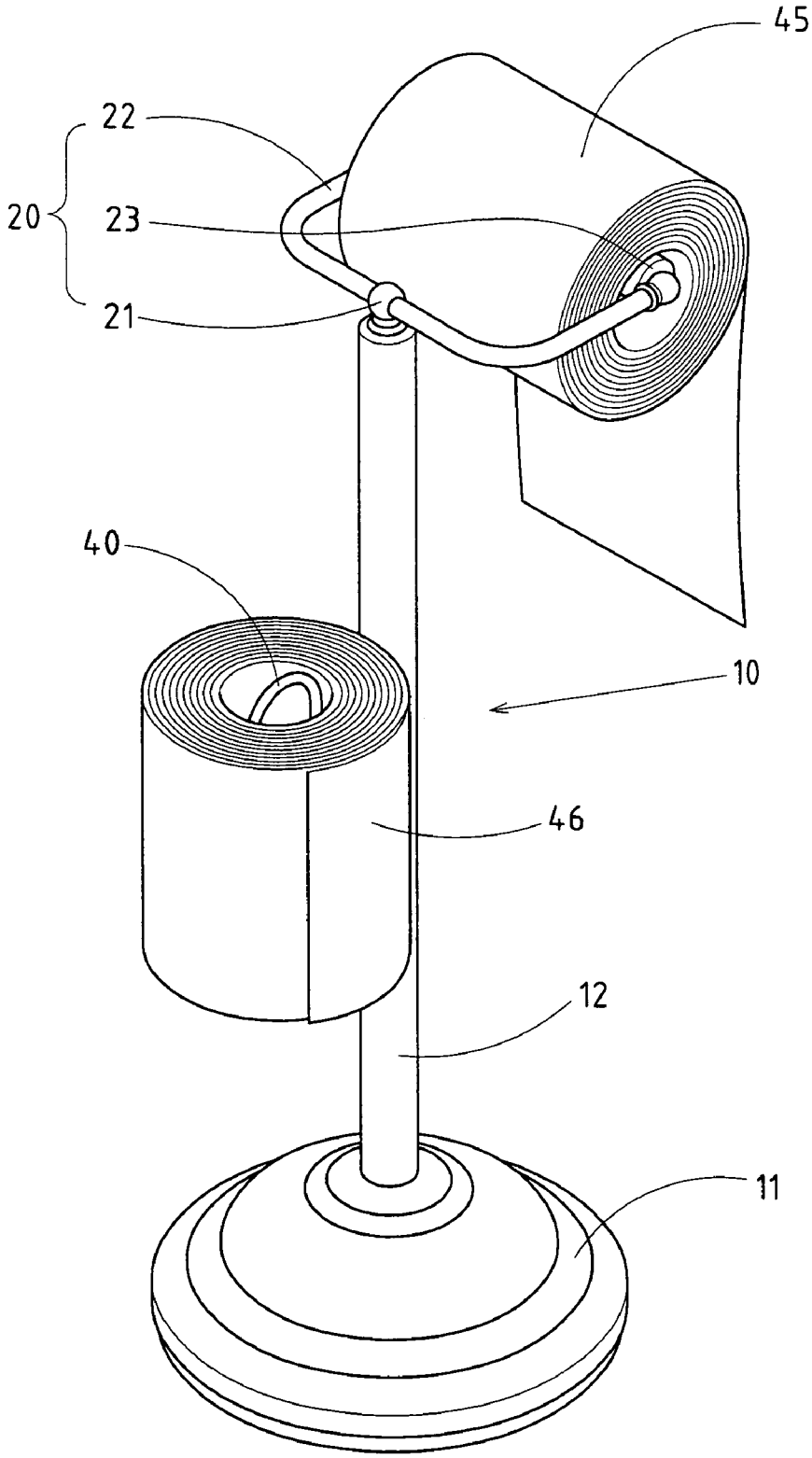
FIG. 6 shows a perspective view of the second preferred embodiment of the present invention at work.
Figure 7:
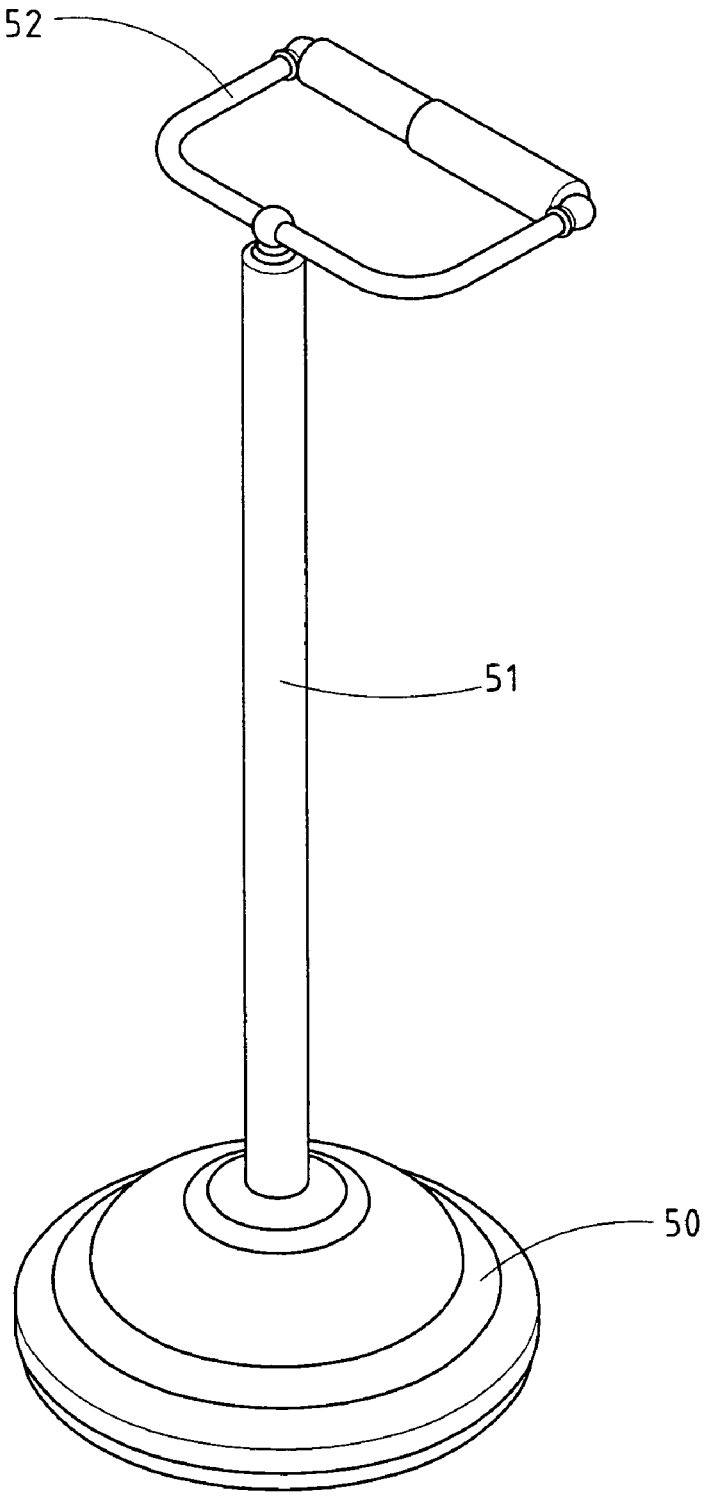
FIG.7 PRIOR ART
FIG. 7 shows a perspective view of a prior art floor rack for holding paper towel roll.

As shown in FIGS. 3–6, the present invention comprises a second holder 40 which is detachably fastened at one end to the lower segment of the upright support post 12. The second holder 40 has a fastening arm 41 and a holding arm 42. The fastening arm 41 is provided with a locating portion 43, which is located in the hollow interior of the upright support post 12 via a through hole 44 located in the lower segment of the upright support post 12, as illustrated in FIG. 5. The locating portion 43 of the fastening arm 41 is removably located in the hollow interior of the upright support post 12. The holding arm 42 is used to hold the standby paper towel roll 46.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A floor rack for holding a plurality of paper towel rolls, the rack comprising:

a base;

a support post affixed at one end to said base and extending vertically upwardly therefrom;

a first holder fastened to an opposite end of said support post, said first holder having a support frame extending generally horizontally outwardly on one side of said support post, said support frame having a holding rod extending entirely between opposite ends of said support frame; and a second holder extending outwardly from an opposite side of said support post, said second holder having a holding arm extending in parallel spaced relation to said support post, said second holder having a fastening arm with one end affixed to said support post and an opposite end joined to a first end of said holding arm, said second holder having an inverted U-shaped member extending from a second end of said holding arm, said second holder positioned on said support post between said first holder and said base.

2. The rack of claim 1, further comprising:

a first paper towel roll freely rotatable on said holding rod of said first holder; and a second paper towel roll positioned on said holding arm of said second holder, said inverted U-shaped member frictionally engaging a tubular core of said second paper towel roll.

3. A floor rack for holding a plurality of paper towel rolls, the rack comprising:

a base;

a support post affixed at one end to said base and extending vertically upwardly therefrom, said support post being tubular and having an inner wall defining a hollow interior;

a first holder fastened to an opposite end of said support post, said first holder having a support frame extending generally horizontally outwardly on one side of said support post, said support frame having a holding rod extending entirely between opposite ends of said support frame, said support post having a hole formed on an opposite side thereof between said base and said first holder; and a second holder extending outwardly from said opposite side of said support post, said second holder having a holding arm extending in parallel spaced relation to said support post, said second holder having a fastening arm extending from a lower end of said holding arm and through said hole of said support post, said fastening arm having a locating portion extending therefrom, said locating portion extending into said hollow interior of said support post and contacting opposite sides of said inner wall.

4. The rack of claim 3, further comprising:

a first paper towel roll freely rotatable on said holding rod of said first holder; and a second paper towel roll positioned on said holding arm of said second holder, said holding arm having an inverted U-shaped member extending from a top end thereof, said inverted U-shaped member frictionally engaging a tubular core of said second paper towel roll.

* * * * *